United States Patent [19]

Rothberg

[11] 4,377,508

[45] Mar. 22, 1983

[54] PROCESS FOR REMOVAL OF RADIOACTIVE MATERIALS FROM AQUEOUS SOLUTIONS

[76] Inventor: Michael R. Rothberg, 8268 S. Locust St., Englewood, Colo. 80112

[21] Appl. No.: 205,051

[22] Filed: Jul. 14, 1980

[51] Int. Cl.[3] ..... G21F 9/10

[52] U.S. Cl. ..... 252/631; 210/721; 210/724; 210/682; 423/11; 423/12

[58] Field of Search ..... 252/631, 632; 423/11, 423/12; 210/715, 721, 724, 682

[56] References Cited

U.S. PATENT DOCUMENTS

| | | | |
|---|---|---|---|
| 4,086,325 | 4/1978 | Cordier et al. | 252/301.1 W |
| 4,234,555 | 11/1980 | Pulley et al. | 252/301.1 W |
| 4,269,706 | 5/1981 | Sondermann | 252/631 |

*Primary Examiner*—Deborah L. Kyle

*Attorney, Agent, or Firm*—Gregg I. Anderson

[57] ABSTRACT

A process for removing dissolved radioactive materials from aqueous solution by incorporating lime in a sufficient dosage to adjust the pH of the water to greater than 11.0 while simultaneously adding a material from the group consisting of hydrogen peroxide, oxygen, ferrous sulfate, ferric chloride and potassium permanganate.

6 Claims, 3 Drawing Figures

$H_2O_2$ - 6 mg / l
Lime
1 Initial pH 4.0
2 Initial pH 8.5
3 Initial pH 8.38

PROCESS FOR REMOVAL OF RADIOACTIVE MATERIALS FROM AQUEOUS SOLUTIONS

BACKGROUND OF THE INVENTION

1. Field of Invention

This invention relates to a process for the removal of radioactive materials from aqueous solutions, and particularly the removal of relatively low concentrations of materials as might occur naturally or after highly contaminated waste water has been treated.

2. Description of the Prior Art

The Water Pollution Control Act and Safe Drinking Water Act have imposed specific requirements on the quality of water discharged into streams and served to the public as potable water. As need increases, the regulations promulgated under both of these pieces of legislation will ultimately place more stringent requirements on both waste discharges and potable water purveyors. These requirements will include limits for radioactive materials, including uranium.

The primary sources for radioactive materials carried in solution are mining operations and certain nuclear fuel producing facilities. As more and more attention is given to the quality of life and technology's impact on society, as well as plant and animal life, the treatment of even these relatively low concentrations of radioactive materials becomes more important. For example, the Environmental Protection Agency has given the Colorado Department of Health a recommendation that dissolved uranium not exceed 0.015 mg/l. This is substantially less than concentrations 0.18 to 2.3 mg/l occurring in natural flowing streams as a result of uranium mining operations.

The prior art has directed much attention to the reduction of high level concentration of radioactive materials and waste products resulting from the processing, production and decontamination of nuclear fission materials. Precipitation of the radioactive material from the solution is an often used part of these processes. U.S. Pat. No. 2,854,315 to Alter et al describes the treatment of a nitric acid solution contaminated by high level amounts of radioactive material by the addition of alkali metal hydroxides, which precipitates the radioactive wastes for later disposal. The removal of fission products, primarily from sea water, by precipitation is described in U.S. Pat. No. 3,013,978, to Rosinski. The process described relies on a mixture of precipitants, such as manganese dioxide or chromic oxide and ferric hydroxide, and the pH is allowed to vary widely. U.S. Pat. No. 2,766,204 to Lowe, specifies that the pH be held within a relatively narrow range of 3.6 to 4.4, by addition of an alkali hydroxide or an alkali carbonate, during a FeS precipitation process, which is conducted at low temperatures, about 0° C. The Lowe process also suggests initially adjusting the solution to a pH of 1.0 with nitric acid.

Direct precipitation of radioactive nuclear fission products from water by the addition of water soluble titanium compounds is disclosed in U.S. Pat. No. 3,330,771 to Komatsu et al. The dissolved radioactive cations along with the colloidal radioactive substances are coprecipitated and removed from solution.

Lime is utilized in a declading process to precipitate fluorides and neutralize sulfuric acid in Detilleux et al, U.S. Pat. No. 3,557,013. In Detilleux, the high level wastes remain in the solution after the fluorides are precipitated out by adding lime, evaporation of the remaining solution over a long period of time leaves a solid mass of radioactive wastes which are accumulated for further disposal.

Lime is also used to precipitate out florides in Crossley, U.S. Pat. No. 3,961,027. The remaining solution is distilled and then treated by cationic ion exchange leaving water containing small amounts of uranium, fluoride and ammonia which can be recycled to react with $UF_6$ or combined with ammonium hydroxide distillate and then treated with additional concentrated ammonium hydroxide to form a solution of desired $NH_3$ content for use in precipitating ammonium diuranate.

Even more complex processes are used to treat waste water solutions, as disclosed in U.S. Pat. No. 3,008,904, to Johnson et al, wherein a phosphate, silicate or borate is added to the solution which is in turn entrained by a steam spray into a space heated to between 250° and 400° C. The residue is calcined and the water vapor and gaseous products separated.

Treatment of the water resulting from uranium ore processing, by evaporation and crystallization is shown in U.S. Pat. No. 3,988,414 to Klicka et al. Naturally occurring radioactive materials, including ruthenium and iodine, are mechanically filtered out of water to be used for drinking purposes, in an apparatus described in U.S. Pat. No. 3,405,050, to Bovard et al, embodying a series of stacked filters, one of the filters containing a resin for ion exchange with the radioactive materials.

Bovard also describes the prior art use of lime and sodium carbonate in water treatment. Lime is described as a flocculant which can help coagulate unspecified radioactive elements. Lime and sodium carbonate are reported to have experienced "some success" in removal of radioactive elements in water treatment work.

Ion exchange has been widely used in radioactive waste water treatment. It is effective, but involves costly resins and decreases in efficiency as competing nonradioactive salts increase in concentration. Reverse osmosis, a process utilizing a membrane and high pressure energy intensive pumps to create a brine product, is likewise expensive and not readily adaptable to large city water treatment plants.

Few of the above described processes are directly applicable to small amounts of naturally occurring radioactive materials dissolved in aqueous solution. The processes that involve precipitation are generally directed at expensive less readily available, precipitating agents.

Conventional city water treatment processes do use lime as a coagulant during the treatment of the water. Relatively small amounts of lime, less than 10 mg/l, are added to form colloids, which have the physical property of adhesion. Flocculation of the suspended colloids allows various colloidal massesto agglomerate or adhere to each other and eventually settle to the bottom of a tank. This process is primarily directed to matter which is suspended in the water to be treated, rather than dissolved materials.

Other water treatment works rely on lime or lime combined with soda ash to soften, remove hardness, and remove divalent cationic elements such as $Ca^{++}$ and $Mg^{++}$. These treatment processes add soda ash and/or lime for purposes of precipitating the divalent cations from solution as $Mg(OH)_2$ and $CaCO_3$. The lime and soda ash treatment process is applicable for the removal of certain fission products, particularly strontium. However, to accomplish these removals very high chemical doses are required (300 mg/l lime). Uranium is not a fission product, and remains in solution, unaffected by the lime-soda ash softening process.

OBJECTS AND SUMMARY OF THE INVENTION

The principal object of the present invention is to provide a process for removing low level quantities of dissolved uranium and other radioactive materials from aqueous solutions, including drinking water.

A related object of the invention is to provide a process which can be conducted at naturally occurring temperatures and pressures.

A further object of the invention is to provide a process which is relatively fast and inexpensive.

Still a further object of the invention is to provide a process for removal of radioactive materials that can be incorporated in conventional city water treatment systems.

Another object of the invention is to produce an effluent containing very low concentrations of radioactive materials, not presently required by governmental standards, but which if not removed may in fact violate future more restrictive governmental standards.

Still a further object of the invention is to provide a process that can be used by city water treatment plants with little or no modification to existing facilities.

Another object of the invention is to provide a process which can be used as an industrial waste treatment process, such as for treating mine dewatering streams or uranium processing waste streams.

A further object of the invention is to provide a process that produces a precipitate that can be reprocessed conventionally to recover uranium and other radioactive materials.

In accordance with the objects of the invention, the process broadly involves precipitation by the addition of lime ($Ca(OH)_2$) and hydrogen peroxide ($H_2O_2$) to an aqueous solution of dissolved radioactive materials, primarily dissolved uranium. The contaminated water may be naturally occurring water, or an industrial water containing low level radioactive contamination, or the like. In the particular application contemplated, the contamination arises primarily from water runoff associated with a uranium mining operation in which uranium concentrations, calculated on the basis of dissolved uranium present, vary from about 0.18 mg/l up to about 2.3 mg/l.

The lime and hydrogen peroxide process is dependent upon achieving a pH of at least 11.0. Lime and hydrogen peroxide are added at a rapid mix (100 r.p.m.) for about two minutes and the entire solution is slow mixed for approximately twenty minutes to flocculate the suspended particles, coming out of solution, into an agglomerated mass. As lime was added, increasing the pH of the solution, percentages of removal of radioactive material increase. The highest percentage of removal of dissolved uranium resulted when the pH was adjusted to a value of over 11.0.

Certain additive compounds including hydrogen peroxide, ferrous sulfate, ferric chloride, potassium permanganate and oxygen, were found to act as oxidants or catalysts in the reaction of the radioactive materials with lime.

DESCRIPTION OF THE PREFERRED EMBODIMENT

Figure 1:
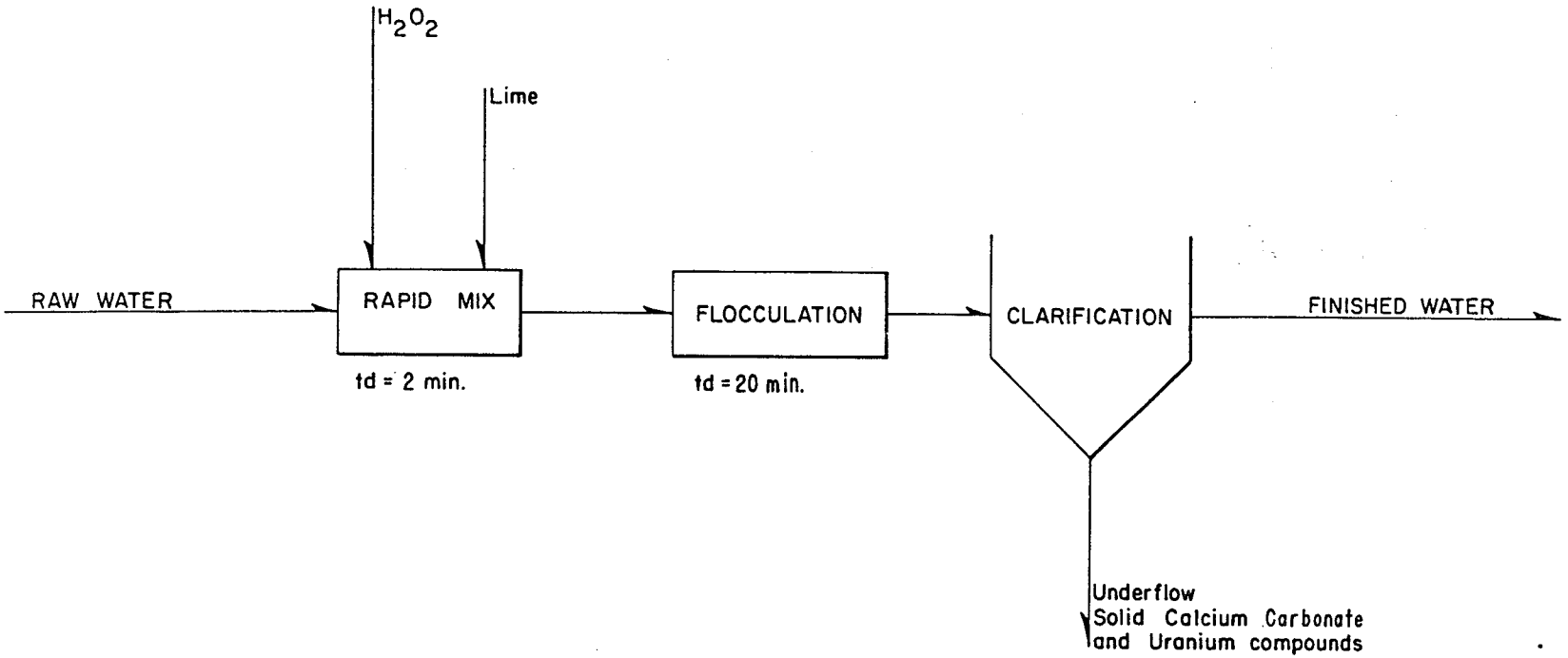
FIG. 1 is a flow chart of the process of the present invention.

The process of the present invention, a flow chart of which is shown in FIG. 1, is based on the precipitation of radioactive materials, particularly uranium, dissolved in aqueous solutions. The dissolved radioactive materials may be from a naturally flowing stream, or a uranium mining operation water treatment plant. The water from the stream is destined to be treated by a conventional city water treatment facility for drinking and home use.

In accordance with the present invention, an aqueous solution containing contaminates, including dissolved uranium at levels of 0.18 to 2.3 ml/l, is adjusted to a pH of greater than 11.0 by the addition of lime [$Ca(OH)_2$] at a dosage of 90 to 110 mg/l and hydrogen peroxide ($H_2O_2$) at a dosage of 6.0 mg/l, during a rapid mix (100 r.p.m.) of the solution over a period of two minutes. A slow mix over a period of twenty minutes follows, during which flocculation takes place. During flocculation, small particles formed by the addition of the lime precipitating agent collect together in colloidal masses. The particles agglomerate together to the extent that their own size and weight allow the particles to settle out of solution, without filtering. After the lime precipitating agent has been added, during the rapid mixing of the solution, and slow mixing or flocculation is accomplished, the precipitate of calcium carbonate and uranium compounds is removed and the decant solution separated or clarified as finished water. The process is effectively completed at ambient temperature and atmospheric pressure.

It has been found that pH control is critical to obtaining a high percentage, over 90%, removal of dissolved uranium. It has been further discovered that a critical pH value of greater than 11.0 is required for these high removal percentages. This pH is achieved by the addition of approximately 90 to 110 mg/l of lime and 6.0 mg/l of hydrogen peroxide.

Figure 3:
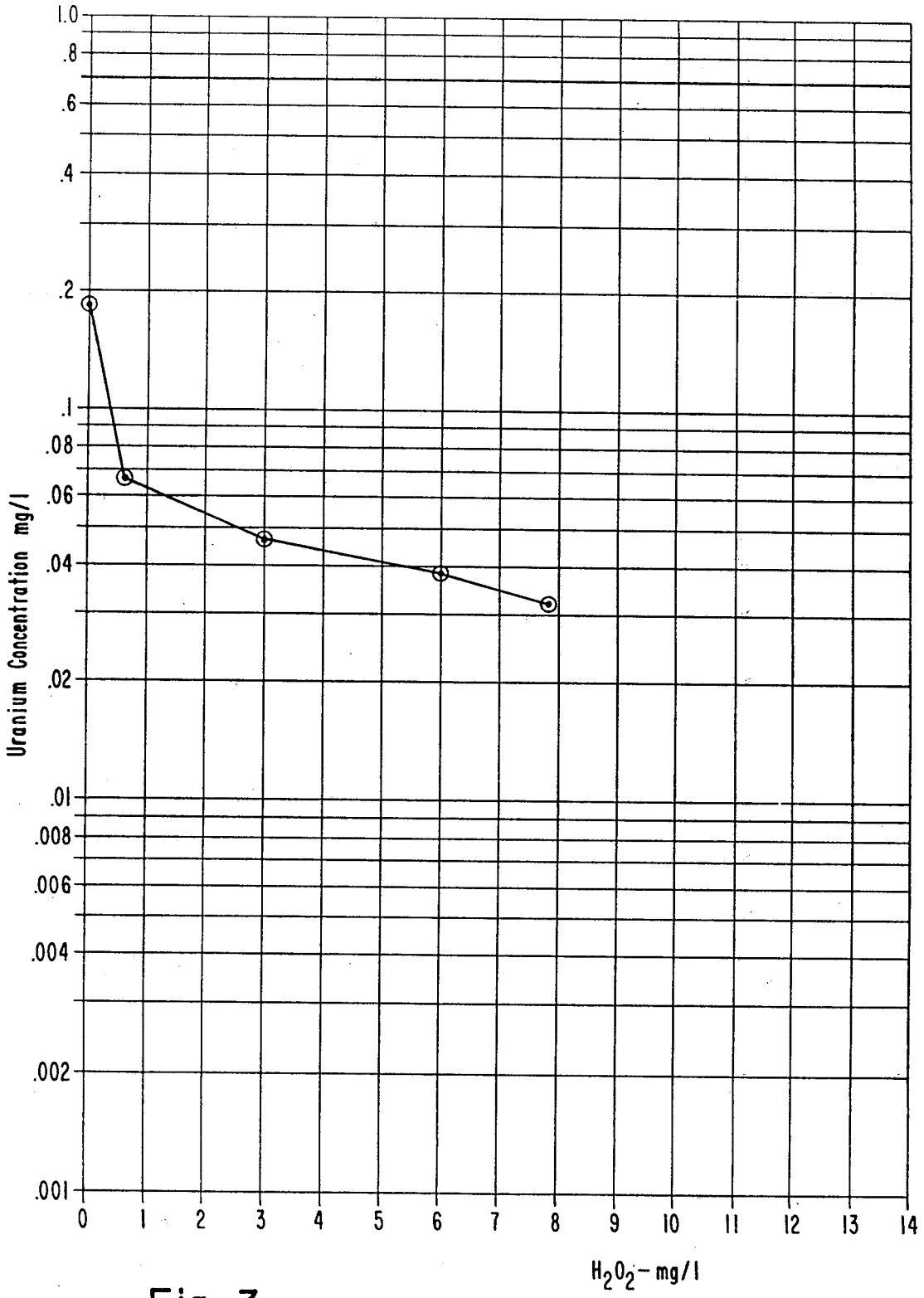
FIG. 3 is a graph of experimental results showing the affect of hydrogen peroxide dosage, combined with a fixed lime dosage of 110 mg/l, on the removal of uranium.

Certain chemicals, namely hydrogen peroxide, ferric chloride and ferrous sulfate, and to a lesser extent oxygen and potassium permanganate, greatly enhance removal efficiencies when added to the solution during the rapid mix portion of the process and in conjunction with lime. Hydrogen peroxide was selected for experimental analysis in connection with lime, at a dosage of 6.0 mg/l. As seen in FIG. 3, increasing the dosage of hydrogen peroxide added to an aqueous solution, to which 110 mg/l of lime has previously been added, greatly enhances the amount of uranium removed from solution, up to 6.0 mg/l of hydrogen peroxide. After 6.0 mg/l of hydrogen peroxide is added, increased removals continue, but at a lesser rate.

Table I shows the greatly enhanced removals experienced with the addition of the aforementioned materials, which act as either catalysts or oxidants.

TABLE I

| Oxidant or Catalyst | Dosage | pH After Addition of Lime | Dissolved Uranium - mg/l Beginning | End | % Removal |
|---|---|---|---|---|---|
| Oxygen | 10 minutes | 11.0 | 0.21 | 0.15 | 29 |
| Potassium Permanganate | 2 mg/l | 11.0 | 0.21 | 0.060 | 71 |
| Hydrogen Peroxide | 6 mg/l | 11.0 | 0.21 | 0.006 | 97 |
| Ferric Chloride | 35 mg/l | 11.0 | 0.21 | 0.01 | 95 |
| Ferrous Sulfate | 100 mg/l | 11.0 | 0.21 | 0.006 | 97 |

Addition of lime without the materials of Table I resulted in very low percentages of removals of dissolved uranium, about 32%. The pH was raised to 10.83 with lime alone.

Figure 2:
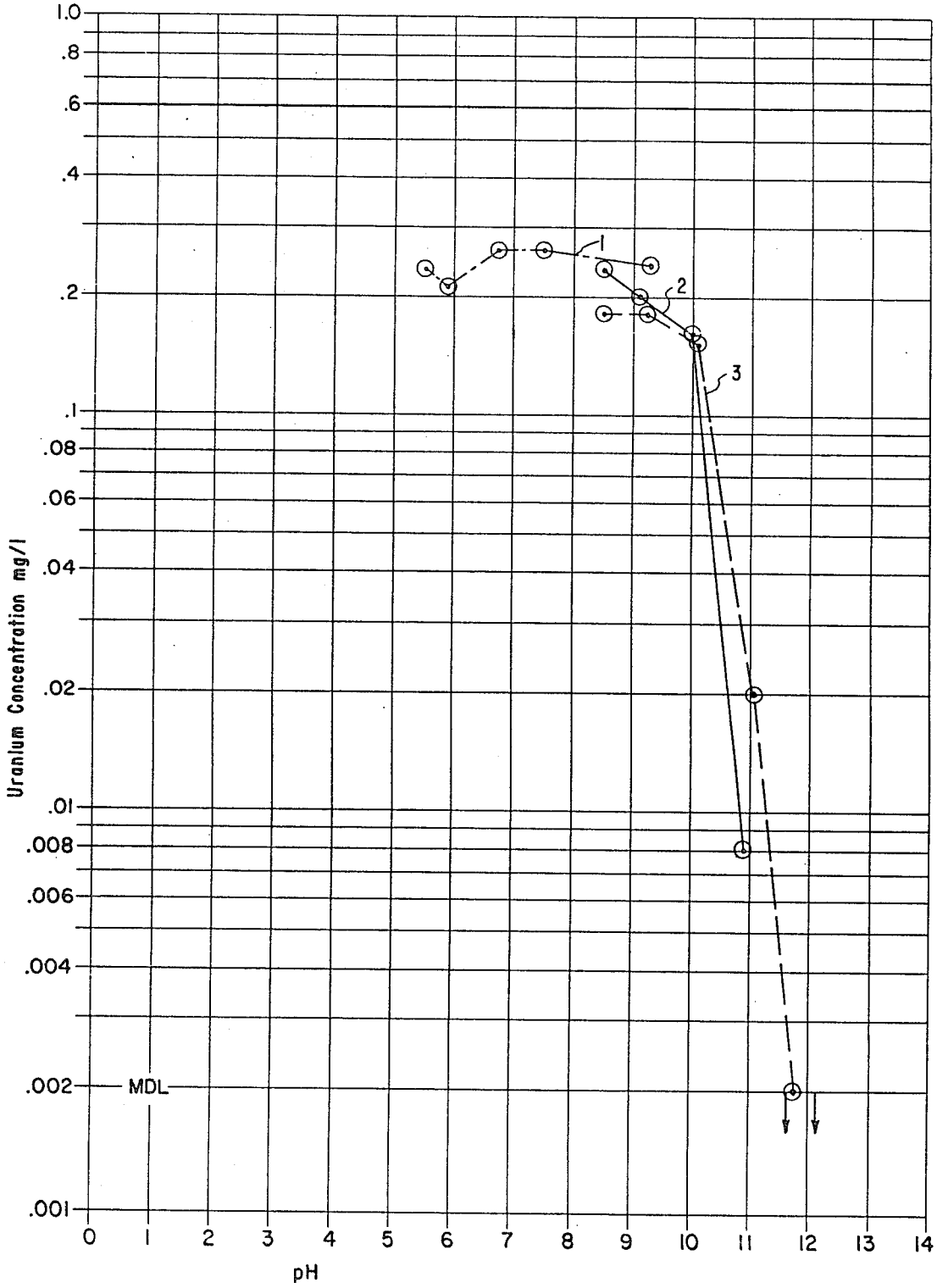
FIG. 2 is a graph of experimental results showing the affect of pH on removal of uranium as a result of the lime process of the present invention.

Experimental test data showing removal of uranium by the addition of lime and hydrogen peroxide are shown in FIG. 2 for a solution of uranium obtained downstream from the uranium waste water treatment plant, at an initial uranium concentration of about 0.2 mg/l.

The experimental results show that using lime as a precipitating agent and hydrogen peroxide as an enhancer, acting either as a catalyst or oxidant, adjustment of the final pH to greater than 11.0 results in significant uranium removals. The pH of 11.0 corresponds to approximately 110 mg/l of lime. It is of course understood that the alkalinity and pH of the solution itself dictate the initial pH. If the initial pH were relatively low, about a pH of 4.0 as seen in curve 1 of FIG. 2 for example, a higher dosage of lime would be needed to correct the pH to slightly over 11.0 and obtain significant removals.

Three curves are shown in FIG. 2 representing different sets of data obtained from an aqueous solution containing an initial uranium concentration of about 0.2 mg/l.

Curve 1 was adjusted to a pH of 4.0 by nitric acid. Lime dosage was incrementally increased up to 110 mg/l, with resulting increases in pH, from 5.5 to 9.2. No removal of uranium was measured. As was mentioned above, the reason for failure to measure any removal was a result of the entire dosage of lime (110 mg/l) being used to raise the pH, rather than exceed a pH of 11.0, as is needed to obtain significant removals of uranium compounds.

Curve 2 started with an initial unadjusted pH of 8.5. Lime dosage was incrementally increased until pH 11.0 was reached. At pH 11.0, very high uranium removals were measured, resulting in less than 0.015 mg/l of uranium remaining in solution.

Curve 3 had an initial pH of 8.38. Lime dosage was incrementally increased until a pH of 11.8 was achieved. Again at pH 11.0, very high percentages of removal of uranium were measured, resulting in less than 0.002 mg/l of dissolved uranium remaining in solution, the minimum detectable limit (MDL) of the analytical technique.

As can be seen from the experimental results of FIG. 2, the initial starting pH must be adjusted to above 8.0 for a dosage of 110 mg/l of lime to achieve any significant removals when used in conjunction with hydrogen peroxide. Thus, lime, a base, can be added initially to achieve the essentially neutral pH, 7.0 to 8.0, required to start the process.

If pH of the solution is greater than 11.0 to start, some lime dosage will be required to initiate the reaction. The exact amount can be determined by incremental additions of lime, and 6.0 mg/l of $H_2O_2$, until precipitation starts. Once started the precipitation reaction will rapidly take place, removing dissolved uranium compounds to the extent seen when initial pH is below 11.0 and then raised to over 11.0.

Table II shows an analysis of an aqueous solution from a uranium mine dewatering stream. The solution was prefiltered through a 0.45 micron filter to insure that only dissolved materials were present for analysis. A range of concentrations for the elements forming the solution is shown in Table II based on various analyses taken. The ranges also reflect two sampling points, one at the end of the uranium mine waste water treatment plant, the other at a stream into which the treated uranium waste water flows. For uranium, the higher concentrations occur at the treatment site, the lower uranium concentrations occur at the stream where additional water has diluted the treated water.

TABLE II

| Parameter | Characteristics of Aqueous Solution Concentrations | Units |
|---|---|---|
| Turbidity | .37–1.0 | JTU |
| pH | 7.0–8.6 | |
| Specific Conductance | 400–600 | αmho/cm |
| Hardness | 38–120 | mg/l as $CaCO_3$ |
| Alkalinity | 85 | mg/l as $CaCO_3$ |
| Aluminum | .18–35 | mg/l |
| Barium | .034–.989 | mg/l |
| Calcium | 11–40 | mg/l |
| Chlorides | 23–360 | mg/l |
| Chromium | .002–.010 | mg/l |
| Copper | .006–.195 | mg/l |
| Iron | .062–.52 | mg/l |
| Lead | .001–0.010 | mg/l |
| Magnesium | .97–2.2 | mg/l |
| Manganese | .003–.058 | mg/l |
| Nickel | .001–.008 | mg/l |
| Phosphate | 0.03 | mg/l |
| Potassium | 2.8 | mg/l |
| Sodium | 30.5 | mg/l |
| Sulfate | 215–925 | mg/l |
| Strontium | .303–1.2 | mg/l |
| Uranium | .18–2.3 | mg/l |
| Alpha | 160–1200 | pCi/l |
| Beta | 122–1300 | pCi/l |

It is believed that a clear understanding of the process of the present invention will be gained by referring to the following examples of a specific embodiment of lime with hydrogen peroxide at 6.0 mg/l.

EXAMPLE 1

The aqueous solution described in Table II, obtained from the uranium waste water treatment plant, at ambient temperature and pressure, having the characteristics as previously set forth was adjusted to a pH greater than or equal to 11.0 by the addition of approximately 110 mg/l of hydrated lime. To this solution 6.0 mg/l of $H_2O_2$ was added during two minutes of rapid mixing (110 r.p.m.). The solution was flocculated by slow mixing (20 r.p.m.) for approximately twenty minutes. The heavy precipitate was allowed to settle under quiescent conditions for five minutes. The decant solution was removed, filtered and analyzed for uranium, and alpha and beta activity. The results of this analysis are shown in Table III.

TABLE III

| Parameter | Initial Value | Final Value |
|---|---|---|
| Uranium | 2.3 mg/l | 0.080 mg/l |
| Alpha | 1120 ± 40 pCi/l | 66 ± 10 pCi/l |
| Beta | 1300 ± 40 pCi/l | 30 ± 24 pCi/l |

EXAMPLE 2

The aqueous solution described in Table II, obtained from the stream into which the uranium waste water plant discharges treated water was adjusted to a pH greater than or equal to 11.0 by the addition of approximately 110 mg/l of hydrated lime. To this solution 6.0 mg/l of $H_2O_2$ was added during two minutes of rapid mixing (100 r.p.m.). The solution was flocculated by slow mixing (20 r.p.m.) for approximately twenty minutes. The heavy precipitate was allowed to settle under quiescent conditions for five minutes. The decant solution was removed, filtered, and analyzed for uranium, and alpha and beta activity. The results of this analysis are shown in Table IV.

TABLE IV

| Parameter | Initial Value | Final Value |
|---|---|---|
| Uranium | 0.20 mg/l | 0.010 mg/l |
| Alpha | 160 ± 10 pCi/l | 9.7 ± 2.5 pCi/l |
| Beta | 122 ± 13 pCi/l | 25 ± 11 pCi/l |

It will also be seen from the foregoing examples that not only is uranium, and its associated alpha particle emissions level lowered, but beta particle emissions, resulting from radioactive material other than uranium, are also lowered. Thus it can be seen that the process has an effect on other radioactive material besides uranium.

The process of the present invention did not lower dissolved uranium concentration to less than 0.015 mg/l when water of relatively high uranium concentration obtained from the uranium waste water treatment plant was initially processed. A second cycle of the process of the invention on the decant solution would bring the uranium concentration to the desired level as seen in Example 2.

Although the present invention has been described with a certain degree of particularity, it is understood that the present disclosure has been made by way of example and that changes in detail may be made without departing from the spirit of the invention.

I claim:

1. A process for decontaminating a water solution having contained therein naturally occurring radioactive materials having both alpha and beta activity, said solution having a pH of less than 11.0, comprising the following steps: adjusting the pH of the solution to at least 8.0; incorporating lime into the solution to obtain a pH of greater than 11.0, the dosage of lime being on the order of 110 mg/l; simultaneously incorporating with the lime approximately 6.0 mg/l of hydrogen peroxide and rapidly mixing said solution; slowly mixing said solution for a period of about twenty minutes to thereby form colloidal particles in said solution; and separating the colloidal particles from the solution.

2. The invention as defined in claim 1 wherein oxygen bubbled through the solution for ten minutes is substituted for the 6.0 mg/l of hydrogen peroxide.

3. The invention as defined in claim 1 wherein 2.0 mg/l of potassium permanganate is substituted for the 6.0 mg/l of hydrogen peroxide.

4. The invention as defined in claim 1 wherein 35.0 mg/l of ferric chloride is substituted for the 6.0 mg/l of hydrogen peroxide.

5. The invention as defined in claim 1 wherein 100.0 mg/l of ferrous sulfate is substituted for the 6.0 mg/l of hydrogen peroxide.

6. A process for decontaminating a water solution having contained therein naturally occurring radioactive materials having both alpha and beta activity, said solution having a pH of greater than 11.0, comprising the following steps: incorporating lime and a 6.0 mg/l dosage of hydrogen peroxide into the solution until a precipitate is observed; and separating the precipitate from the solution.

* * * * *